US008523321B2

(12) United States Patent
Ito

(10) Patent No.: US 8,523,321 B2
(45) Date of Patent: Sep. 3, 2013

(54) LIQUID DROPLET JETTING APPARATUS AND RECORDING APPARATUS

(75) Inventor: Masaharu Ito, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 993 days.

(21) Appl. No.: 12/151,770

(22) Filed: May 9, 2008

(65) Prior Publication Data

US 2008/0303862 A1 Dec. 11, 2008

(30) Foreign Application Priority Data

May 11, 2007 (JP) ..... 2007-126836

(51) Int. Cl.
*B41J 2/135* (2006.01)

(52) U.S. Cl.
USPC ..... 347/44; 347/68

(58) Field of Classification Search
USPC ..... 347/44, 85, 94, 68
See application file for complete search history.

(56) References Cited

U.S. PATENT DOCUMENTS

| | | | | | |
|---|---|---|---|---|---|
| 4,158,847 | A | * | 6/1979 | Heinzl et al. | 347/40 |
| 4,233,610 | A | * | 11/1980 | Fischbeck et al. | 347/94 |
| 4,320,406 | A | * | 3/1982 | Heinzl | 347/43 |
| 4,571,599 | A | * | 2/1986 | Rezanka | 347/87 |
| 4,680,595 | A | * | 7/1987 | Cruz-Uribe et al. | 347/40 |
| 5,021,809 | A | * | 6/1991 | Abe et al. | 347/94 |
| 5,148,185 | A | * | 9/1992 | Abe et al. | 347/65 |
| 5,155,498 | A | * | 10/1992 | Roy et al. | 347/11 |
| 5,157,420 | A | * | 10/1992 | Naka et al. | 347/40 |
| 5,455,615 | A | * | 10/1995 | Burr et al. | 347/92 |
| 5,519,425 | A | * | 5/1996 | Dietl et al. | 347/87 |
| 5,748,214 | A | * | 5/1998 | Usui et al. | 347/70 |
| 5,774,145 | A | * | 6/1998 | Morita et al. | 347/43 |
| 5,777,648 | A | * | 7/1998 | Scheffelin et al. | 347/87 |
| 5,808,643 | A | * | 9/1998 | Tracy et al. | 347/92 |
| 5,815,184 | A | * | 9/1998 | Ujita et al. | 347/87 |
| 5,867,195 | A | * | 2/1999 | Kaneko et al. | 347/92 |
| 5,975,681 | A | * | 11/1999 | Ogasawara et al. | 347/47 |
| 6,000,777 | A | * | 12/1999 | Nozawa et al. | 347/20 |
| 6,168,265 | B1 | * | 1/2001 | Takata | 347/85 |
| 6,361,155 | B1 | * | 3/2002 | Kanda et al. | 347/70 |

(Continued)

FOREIGN PATENT DOCUMENTS

| | | | |
|---|---|---|---|
| JP | 3234631 | | 10/1991 |
| JP | 04197641 | A * | 7/1992 |

(Continued)

*Primary Examiner* — Charlie Peng
*Assistant Examiner* — Peter Radkowski
(74) *Attorney, Agent, or Firm* — Frommer Lawrence & Haug LLP

(57) ABSTRACT

A liquid droplet jetting apparatus includes a common liquid chamber to which the liquid is supplied, a plurality of pressure chambers which communicate with the common liquid chamber and which cause a pressure change in the liquid, a plurality of nozzles which jet the droplets of the liquid, a pressure attenuation chamber which has a throttled portion having a cross-sectional area smaller than that of the common liquid chamber, and an attenuation portion having a cross-sectional area greater than that of the throttled portion, the attenuation portion being connected to one end portion of the common liquid chamber via the throttled portion, a discharge port formed in the pressure attenuation chamber, a discharge channel connected to the discharge port, and having a throttle in which a channel area of the discharge channel is decreased, and a dummy nozzle connected to the discharge port via the discharge channel.

22 Claims, 6 Drawing Sheets

(56) References Cited

U.S. PATENT DOCUMENTS

| | | | | |
|---|---|---|---|---|
| 6,520,633 | B2 * | 2/2003 | Nakamura | 347/93 |
| 6,634,741 | B2 * | 10/2003 | Kataoka et al. | 347/92 |
| 6,692,109 | B2 * | 2/2004 | Hirota et al. | 347/54 |
| 6,719,404 | B2 * | 4/2004 | Kobayashi | 347/54 |
| 6,742,883 | B1 * | 6/2004 | Takata | 347/92 |
| 6,830,325 | B2 * | 12/2004 | Hirota et al. | 347/94 |
| 6,979,078 | B2 * | 12/2005 | Ito et al. | 347/71 |
| 7,305,764 | B2 * | 12/2007 | Kitahara | 29/890.1 |
| 7,479,256 | B1 * | 1/2009 | Gruhler et al. | 422/100 |
| 2001/0055053 | A1 * | 12/2001 | Kataoka et al. | 347/92 |
| 2002/0042993 | A1 * | 4/2002 | Umehara | 29/890.1 |
| 2002/0051038 | A1 * | 5/2002 | Ito | 347/54 |
| 2003/0156158 | A1 * | 8/2003 | Hirota et al. | 347/54 |
| 2003/0160841 | A1 * | 8/2003 | Takata et al. | 347/50 |
| 2003/0210305 | A1 * | 11/2003 | Ito et al. | 347/68 |
| 2004/0130594 | A1 * | 7/2004 | Watanabe et al. | 347/40 |
| 2004/0165047 | A1 * | 8/2004 | Takata | 347/92 |
| 2005/0023034 | A1 * | 2/2005 | Ishida et al. | 174/264 |
| 2005/0062807 | A1 * | 3/2005 | Ito et al. | 347/72 |
| 2006/0007272 | A1 * | 1/2006 | Ogata et al. | 347/70 |
| 2007/0091145 | A1 * | 4/2007 | Takahashi et al. | 347/54 |
| 2007/0103519 | A1 * | 5/2007 | Takahashi et al. | 347/85 |
| 2007/0103524 | A1 * | 5/2007 | Ito | 347/92 |
| 2007/0146440 | A1 * | 6/2007 | Kojima et al. | 347/68 |

FOREIGN PATENT DOCUMENTS

| | | | |
|---|---|---|---|
| JP | 5057894 | | 3/1993 |
| JP | 8058086 | | 3/1996 |
| JP | 8187862 | | 7/1996 |
| JP | 08187862 | A * | 7/1996 |
| JP | 20032266010 | A * | 8/2003 |
| JP | 2004358737 | | 12/2004 |
| JP | 2005-199443 | | 7/2005 |
| JP | 2005199443 | A * | 7/2005 |

* cited by examiner

LIQUID DROPLET JETTING APPARATUS AND RECORDING APPARATUS

CROSS REFERENCE TO RELATED APPLICATION

The present application claims priority from Japanese Patent Application No. 2007-126836, filed on May 11, 2007, the disclosure of which is incorporated herein by reference in its entirety.

BACKGROUND OF THE INVENTION

1. Field of the Invention

The present invention relates to a liquid droplet jetting apparatus such as an ink-jet head which jets liquid droplets from a plurality of nozzles, and a recording apparatus which includes the liquid droplet jetting apparatus.

2. Description of the Related Art

An ink-jet head which jets an ink as liquid droplets has been known as a liquid droplet jetting apparatus. The ink-jet head has a nozzle row which includes a plurality of nozzles and a common liquid chamber to which the ink is supplied from an ink tank. The common liquid chamber extends along the nozzle row and each of the nozzles in the nozzle row is connected to the common liquid chamber via a pressure chamber. In this ink-jet head, the ink is supplied from the ink tank to one end portion, of the common liquid chamber, in a direction in which the nozzle row is arranged, and by applying a pressure fluctuation to the pressure chamber, the ink is jetted from each nozzle as droplets of ink (ink droplets). In the ink-jet head in which, the ink flows through the common liquid chamber from the one end portion to the other end portion, air bubbles which are generated in the ink and grown up are susceptible to be accumulated, and a jetting defect is susceptible to occur in nozzles, in the nozzle row, which are arranged at the other end portion side of the common liquid chamber. Therefore, in a stacked ink-jet recording head described in U.S. Pat. No. 5,748,214A (corresponds to Japanese Patent Application Laid-open No. H8-58086), for example, by arranging so-called dummy nozzles which are not used in an image formation to communicate with a dead end portion of a common ink chamber, and by carrying out a purge operation of nozzles including the dummy nozzles, air bubbles accumulated in the dead end portion of the common ink chamber are discharged.

Moreover, in such ink-jet head, when a pressure fluctuation is applied to a pressure chamber to jet the ink from a certain nozzle, a pressure wave is propagated to a common liquid chamber which is connected to this nozzle. The pressure wave propagated in this common liquid chamber causes the pressure fluctuation of a pressure chamber which is connected to the other nozzle, and causes an unnecessary jetting and a variation (unevenness) in a jetting volume, thereby causing a so-called cross-talk which is a printing defect phenomenon. In order to suppress the cross-talk, in a liquid droplet jetting recording head described in Japanese Patent No. 2815958, an inclined wall or a pocket chamber is formed in an end portion inside a common liquid chamber, on a side where an ink jetting port is not formed, and by causing a pressure wave to be reflected at the inclined wall or the pocket chamber, the pressure wave is attenuated. Moreover, in a liquid droplet jetting head described in Japanese Patent Application Laid-open No. 2004-358737, a partition is formed on a wall surface of a common liquid chamber, and by causing the pressure wave to be reflected or to be resisted, a resonance state of the pressure wave is suppressed.

Inventors of the present invention, as a result of carrying out various experiments regarding such ink-jet head, found that the pressure wave is concentrated at the other end portion, in the direction of the nozzle row, of the common liquid chamber. Moreover, it was revealed that, when there is a plurality of nozzle rows, and there is a common liquid chamber corresponding to each nozzle row, a pressure wave which is generated by jetting ink droplets from a nozzle in a particular row, is also concentrated in the other end portion, in the direction of the nozzle row, of the common liquid chamber corresponding to the other nozzle row. Therefore, a high pressure fluctuation acts on the dummy nozzles formed in the other end portion in the direction of row, and there has been an occurrence of defect that the ink droplets are jetted from the dummy nozzle due to this pressure fluctuation. Due to such defect, undesired ink droplets are adhered to a recording paper etc.

SUMMARY OF THE INVENTION

An object of the present invention is to provide a liquid droplet jetting apparatus in which it is possible to suppress unnecessary jetting of liquid droplets from a dummy nozzle due to propagation of a pressure wave to a common liquid chamber at the time of jetting the liquid droplets, and a recording apparatus which includes the liquid droplet jetting apparatus.

According to a first aspect of the present invention, there is provided a liquid droplet jetting apparatus which jets a droplet of a liquid, including: a common liquid chamber to which the liquid is supplied; a plurality of pressure chambers which communicate with the common liquid chamber and which causes a pressure change in the liquid; a plurality of nozzles which communicate with the pressure chambers respectively, and each of which jets the droplet of the liquid; a pressure attenuation chamber which has a throttled portion having a cross-sectional area smaller than a cross-sectional area of the common liquid chamber, and an attenuation portion having a cross-sectional area greater than the cross-sectional area of the throttled portion, the attenuation portion being connected to the common liquid chamber via the throttled portion; a discharge port which is formed in the pressure attenuation chamber; a discharge channel which is connected to the discharge port and having a throttle in which a channel area of the discharge channel is decreased; and a dummy nozzle which is connected to the discharge port via the discharge channel, and which is open to an atmosphere.

In the liquid droplet jetting apparatus of the present invention, even when a pressure wave is propagated to the liquid inside the common liquid chamber due to the pressure change in the liquid inside pressure chamber, it is possible to attenuate the pressure wave in the common liquid chamber by an attenuation portion which is connected to the common liquid chamber via the throttled portion. In this pressure attenuation chamber, the discharge port which is connected to the dummy nozzle via the discharge channel is formed, and a throttle in which the channel area of the discharge channel is reduced is formed in this discharge channel. Accordingly, it is possible to attenuate further the pressure wave which is propagated to the discharge channel. Consequently, even when the pressure wave is propagated to the liquid inside the common liquid chamber due to the pressure change in the liquid inside the pressure chamber, it is possible to attenuate this pressure wave before reaching the dummy nozzle, and to prevent the dummy nozzle from unnecessary jetting of the liquid droplets.

In the liquid droplet jetting apparatus of the present invention, the common liquid chamber may extend in a predetermined direction, and the attenuation portion may be connected to an end portion of the common liquid chamber via the throttled portion. By the attenuation portion being connected to the end portion of the common liquid chamber via the throttled portion, it is possible to release the pressure wave concentrated in the end portion of the common liquid chamber to the attenuation portion. Moreover, air bubbles developed inside the common liquid chamber, and accumulated in the end portion of the common liquid chamber flow into the attenuation portion via the throttled portion following the flow of the liquid into the common liquid chamber. On the other hand, since the throttled portion has the cross-sectional area smaller than that of the attenuation portion, it is possible to prevent the air bubbles flowed into the attenuation portion from being flowed to the common liquid chamber against the flow of the liquid inside the common liquid chamber. In other words, it is possible to prevent the air bubbles developed in the common liquid chamber from being accumulated in the common liquid chamber.

The liquid droplet jetting apparatus of the present invention may further include a pressure applying mechanism which is formed to cover the pressure chambers. Since the pressure applying mechanism is formed to cover the pressure chambers, it is possible to apply a jetting pressure to the liquid inside the pressure chamber.

In the liquid droplet jetting apparatus of the present invention, the dummy nozzle may be formed in the vicinity of the end portion of the common liquid chamber. Since it is possible to secure sufficiently a length of the discharge channel by forming the dummy nozzle in the vicinity of the end portion of the common liquid chamber, it is possible to attenuate the pressure wave which is propagated to the liquid inside the discharge channel.

The liquid droplet jetting apparatus of the present invention may further include a plurality of discharge structures each of which includes the discharge port, the discharge channel, and the dummy nozzle. According to the discharge structures, it is possible to disperse the pressure wave which is propagated to the dummy nozzle in each discharge structure, and to decrease the pressure change developed in the dummy nozzle. Therefore, it is possible to suppress further the jetting of the unnecessary liquid droplets from the dummy nozzle due to concentration of the pressure wave in the dummy nozzle.

In the liquid droplet jetting apparatus of the present invention, the discharge structures may include a first discharge structure which includes the discharge port formed in the vicinity of the throttled portion, and a second discharge structure which includes the discharge port formed in the attenuation portion at a position away from the throttled portion. In this case, according to a position of the discharge port included in each of the discharge structures, a difference of high and low is developed in the pressure wave which is propagated from the common liquid chamber to the pressure attenuation chamber. Therefore, it is possible to disperse the pressure wave propagated to each dummy nozzle, and to suppress the unnecessary jetting of the liquid droplets from the dummy nozzle.

According to a second aspect of the present invention, there is provided a liquid droplet jetting apparatus which jets a droplet of a liquid, including: a liquid supply chamber to which the liquid is supplied; a plurality of pressure chambers which communicate with the liquid supply chamber and which causes a pressure change in the liquid; a plurality of nozzles which communicate with the pressure chambers respectively, and each of which jets the droplet of the liquid; a discharge port group which includes a plurality of discharge ports formed in the liquid supply chamber; a plurality of discharge channels which are connected to the discharge ports of the discharge port group respectively, and which communicate with each other; and a dummy nozzle which is connected to the discharge ports via the discharge channels, and which is open to an atmosphere.

In the liquid droplet jetting apparatus of the present invention, since the discharge port group which includes the discharge ports is formed in the liquid supply chamber, and the discharge ports communicate with each other via the discharge channels, and are connected to the dummy nozzle, even when the pressure wave is propagated to the liquid in the liquid supply chamber by the pressure change in the liquid inside the pressure chamber, and even when the pressure wave is propagated to the liquid inside the discharge channels, it is possible to release the pressure wave propagated to the discharge channels toward a discharge port at which the pressure is lower than the other discharge ports. Accordingly, it is possible to suppress the pressure wave propagated to the discharge channel through the discharge port from being concentrated in the dummy nozzle, and to suppress the unnecessary jetting of the liquid droplets from the dummy nozzle.

In the liquid droplet jetting apparatus of the present invention, the liquid supply chamber may extend in a predetermined direction, and the discharge ports included in the discharge port group may be formed in the predetermined direction to be isolated from each other. In this case, a difference of high and low is developed in the pressure wave which is propagated in the liquid supply chamber at a position of each discharge port included in the discharge port group, and it is possible to release the pressure wave propagated from one discharge port to the discharge channel, toward a discharge port at which the pressure is lower than the pressure of the other discharge ports. Therefore, it is possible to suppress the pressure wave from being concentrated in the dummy nozzle, and to suppress the unnecessary jetting of the liquid droplets from the dummy nozzle. By forming each discharge port such that a phase of the pressure wave propagated to the discharge channels is shifted, it is possible to suppress more effectively the pressure wave from being concentrated in the dummy nozzle.

In the liquid droplet jetting apparatus of the present invention, a total of channel lengths of two discharge channels, among the plurality of discharge channels, communicating with two discharge ports among the plurality of discharge ports in the discharge port group respectively, may be greater than a direct distance between the two discharge ports. By letting the direct distance between the two discharge ports and the total of the channel lengths of two discharge channels communicating with the discharge ports respectively to be different, it is possible to attenuate effectively the pressure wave propagated from each discharge port to the dummy nozzle via the discharge channel, and to release the pressure wave propagated from one discharge port toward a discharge port on a lower pressure side. Accordingly, it is possible to suppress the pressure wave from being concentrated in the dummy nozzle, and to suppress the unnecessary jetting of the liquid droplets from the dummy nozzle. According to this structure, it is possible to shift easily the phase of the two pressure waves, and to suppress the concentration of the pressure wave in the dummy nozzle.

In the liquid droplet jetting apparatus of the present invention, the two discharge channels may be joined with each other in a V-shape and then may be connected to the dummy nozzle. In this case, since it is possible to have a sufficient length of two discharge channels, it is possible to attenuate sufficiently the pressure chamber propagated to the dummy nozzle, and to suppress the unnecessary jetting of the liquid droplets from the dummy nozzle. Moreover, it is also possible to overlap the phases of the two pressure waves upon shifting sufficiently, to offset the two pressure waves, and it possible to suppress the concentration of the pressure wave in the dummy nozzle.

In the liquid droplet jetting apparatus of the present invention, the discharge channels may be joined with each other at a predetermined position and then may be connected to the dummy nozzle, and a throttle in which a channel area is reduced than those of the discharge channels may be formed between the predetermined position and the dummy nozzle. In this case, it is possible to release the pressure wave propagated to the discharge channels toward a discharge port on a lower pressure side. Furthermore, due to the existence of the throttle between the predetermined position at which the discharge channels are joined, and the dummy nozzle, it is possible to attenuate the pressure wave before reaching the dummy nozzle, and to suppress even more effectively the pressure wave from being concentrated at the dummy nozzle.

The liquid droplet jetting apparatus of the present invention may further include a plurality of discharge structures each of which includes the discharge port group, the plurality of discharge channels, and the dummy nozzle. Due to the discharge structures, it is possible to disperse the pressure wave propagated to each dummy nozzle, and to reduce the pressure change developed in the dummy nozzle. Therefore, it is possible to suppress the pressure wave from being concentrated at the dummy nozzle, and to suppress the unnecessary jetting of the liquid droplets from the dummy nozzle.

In the liquid droplet jetting apparatus of the present invention, the liquid supply chamber may have a common liquid chamber which extends in a predetermined direction and which is connected to the pressure chambers; and a pressure attenuation chamber which includes a throttled portion having a cross-sectional area smaller than a cross-sectional area of the common liquid chamber, and an attenuation portion having a cross-sectional area greater than the cross-sectional area of the throttled portion, the attenuation portion being connected to an end portion of the common liquid chamber via the throttled portion, and the discharge port group may be formed in the pressure attenuation chamber. In this case, even when the pressure wave is concentrated at the end portion of the common liquid chamber due to the pressure change in the liquid inside the pressure chamber, firstly, it is possible to attenuate the pressure wave in the common liquid chamber, at the attenuation portion which is connected to the common liquid chamber via the throttled portion. Furthermore, since the discharge port group which is connected to the dummy nozzle via the discharge channel is formed in the pressure attenuation chamber, it is possible to suppress the pressure wave attenuated in the attenuation portion from being concentrated in the dummy nozzle upon being propagated through the discharge channels.

The liquid droplet jetting apparatus of the present invention may further include a plurality of discharge structures each of which includes the discharge port group, the plurality of discharge channels, and the dummy nozzle; and the discharge structures may have a first discharge structure in which the discharge port group is formed in the vicinity of the throttled portion, and a second discharge structure in which the discharge port group is formed in the attenuation portion at a position away from the throttled portion. In this case, according to a position of the discharge port group included in each discharge structure, a difference of high and low is developed in the pressure wave which is propagated from the common liquid chamber to the pressure attenuation chamber. Therefore, it is possible to disperse the pressure wave propagated to each dummy nozzle, and to suppress the unnecessary jetting of the liquid droplets from the dummy nozzle.

In the liquid droplet jetting apparatus of the present invention, the discharge ports of the discharge port group in the first discharge structure may include a discharge port formed in the common liquid chamber and a discharge port formed in the attenuation portion; and the discharge ports of the discharge port group of the second discharge structure may be all formed in the attenuation portion. According to this structure, a difference of high and low is developed in the pressure wave which is propagated in the common liquid chamber and the attenuation portion at a position of each discharge port, and it is possible to release the pressure wave propagated from one discharge port to the discharge channel toward a discharge port on a lower pressure side. Moreover, it is possible to prevent air bubbles from being accumulated at the end portion of the common liquid chamber.

In the liquid droplet jetting apparatus of the present invention, the dummy nozzle in each of the first discharge structure and the second discharge structure may be formed in the vicinity of the end portion of the common liquid chamber. Since it is possible to secure sufficiently a length of each discharge channel by forming each dummy nozzle in the vicinity of the end portion of the common liquid chamber, it is possible to attenuate the pressure wave propagated to the liquid inside the discharge channel.

The liquid droplet jetting apparatus of the present invention may further include a pressure applying mechanism which is formed to cover the pressure chambers.

According to a third aspect of the present invention, there is provided a recording apparatus which performs recording on a recording medium by jetting a droplet of a liquid, including: the liquid droplet jetting apparatus as defined in the second aspect of the present invention; and a transporting mechanism which transports the recording medium in a predetermined direction.

According to the recording apparatus of the present invention, it is possible to suppress the unnecessary jetting of the liquid droplets from the dummy nozzle.

The recording apparatus of the present invention, may further include a sucking mechanism which covers the nozzles and the dummy nozzle of the liquid droplet jetting apparatus and which sucks the liquid from the nozzles and the dummy nozzle. In this case, by the sucking mechanism, it is possible to suck air bubbles developed in the liquid supply chamber of the liquid droplet jetting apparatus together with the liquid inside the liquid supply chamber.

In the recording apparatus of the present invention, the liquid supply chamber of the liquid droplet jetting apparatus may extend in the predetermined direction, and the discharge ports included in the discharge port group may be formed in the predetermined direction to be isolated from each other. Furthermore, the liquid supply chamber may have a common liquid chamber which extends in the predetermined direction and which is connected to the pressure chambers; and a pressure attenuation chamber including a throttled portion of which a cross-sectional area is smaller than a cross-sectional area of the common liquid chamber and an attenuation portion of which a cross-sectional area is greater than the cross-sectional area of the throttled portion, the attenuation portion being connected to an end portion of the common liquid chamber via the throttled portion; and the discharge port group may be formed in the pressure attenuation chamber.

DETAILED DESCRIPTION OF THE PREFERRED EMBODIMENTS

Figure 1:
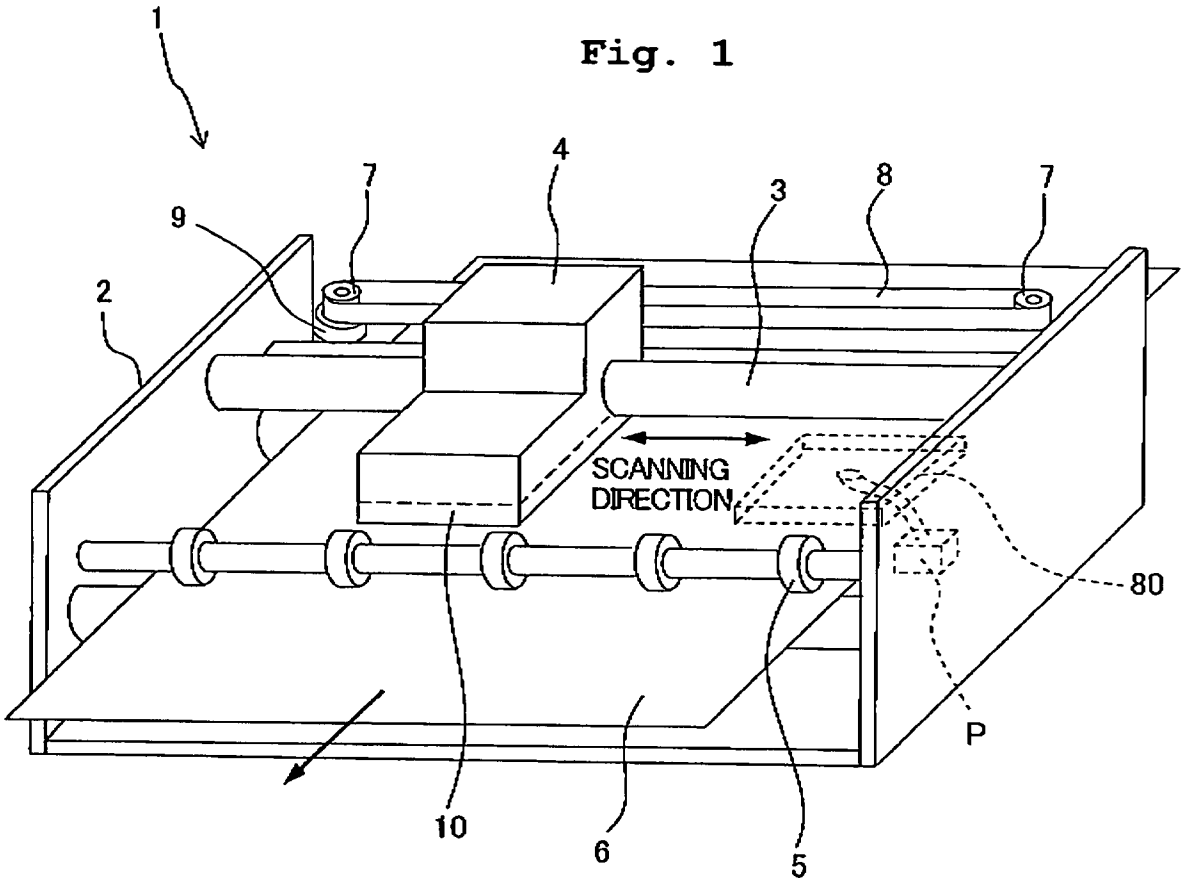
FIG. 1 is a schematic perspective view of an ink-jet printer having an ink-jet head according to an embodiment of the present invention.

The accompanying diagrams are diagrams in which a liquid droplet jetting apparatus of the present invention is substantiated in an ink-jet head 10. FIG. 1 is a schematic perspective view of an ink-jet printer 1 which includes the ink-jet head 10. The ink-jet printer 1 has a guide rod 3 which is installed in a casing 2, and a carriage 4 which is slidably supported by the guide rod 3. The ink-jet head 10 is provided at a lower portion of the carriage 4, and ink droplets are jetted from the ink-jet head 10 toward a recording paper 6 which is transported by a paper feeding roller 5 (transporting mechanism) below the ink-jet head 10. The carriage 4 is joined to a timing belt 8 which is put around a pair of pulleys 7, and the timing belt 8 is arranged parallel to an axial direction of the guide rod 3. A motor 9 which rotates in a normal and reverse direction is provided to one of the pulleys 7, and by this pulley 7 being driven in the normal and reverse direction of rotation, the timing belt 8 reciprocates. By the reciprocation movement of the timing belt 8, the carriage 4 joined to the timing belt 8 and the ink-jet head 10 installed on the carriage 4 move along the guide rod 3. In the following description, a "scanning direction" is a direction in which the carriage 4 moves, and an "extending direction" is a direction in which a common liquid chamber 40, which will be described later, extends (direction of a row of pressure chambers 42), and is a direction orthogonal to the scanning direction.

Figure 2:
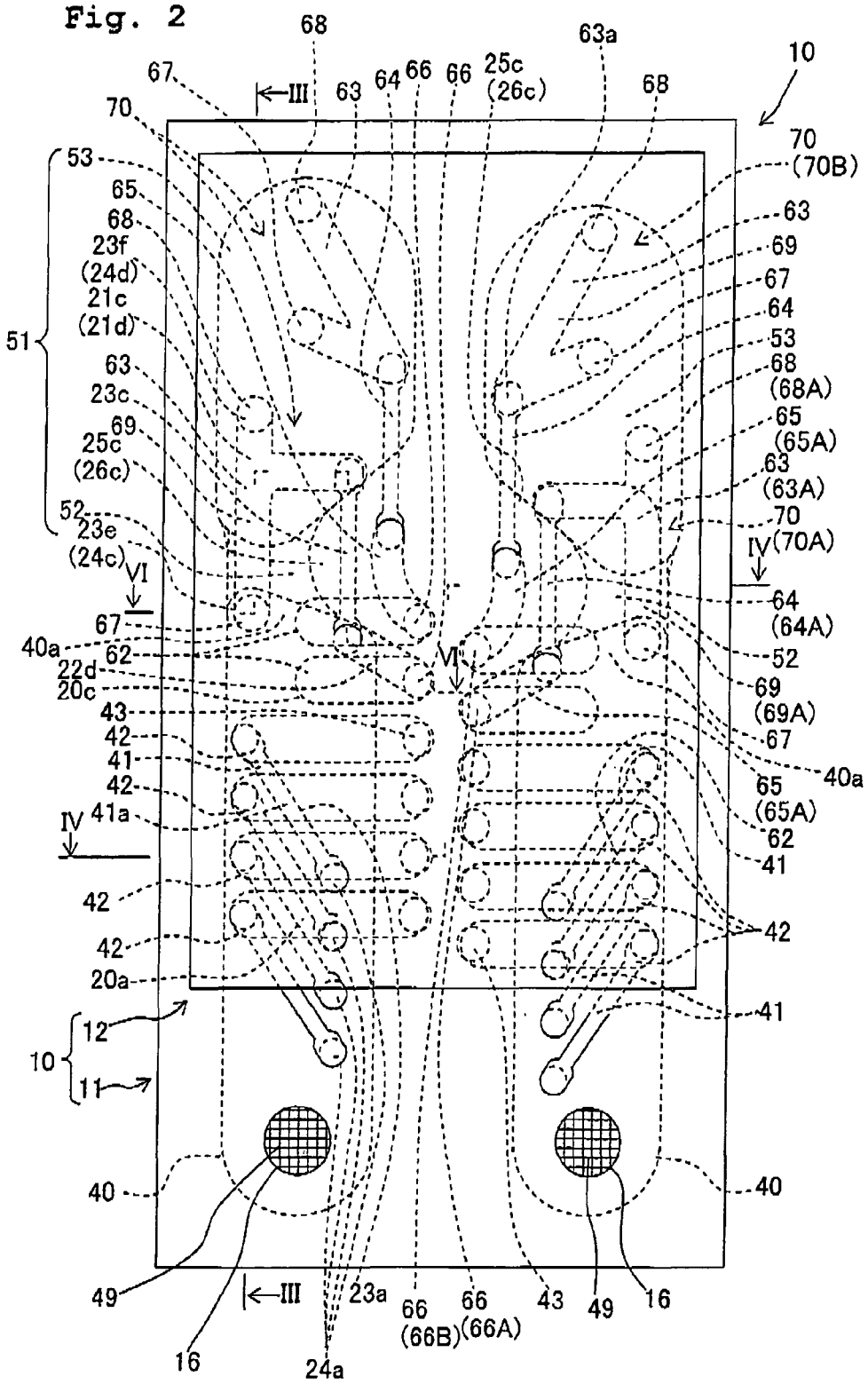
FIG. 2 is a plan view of the ink-jet head shown in FIG. 1.
Figure 3:
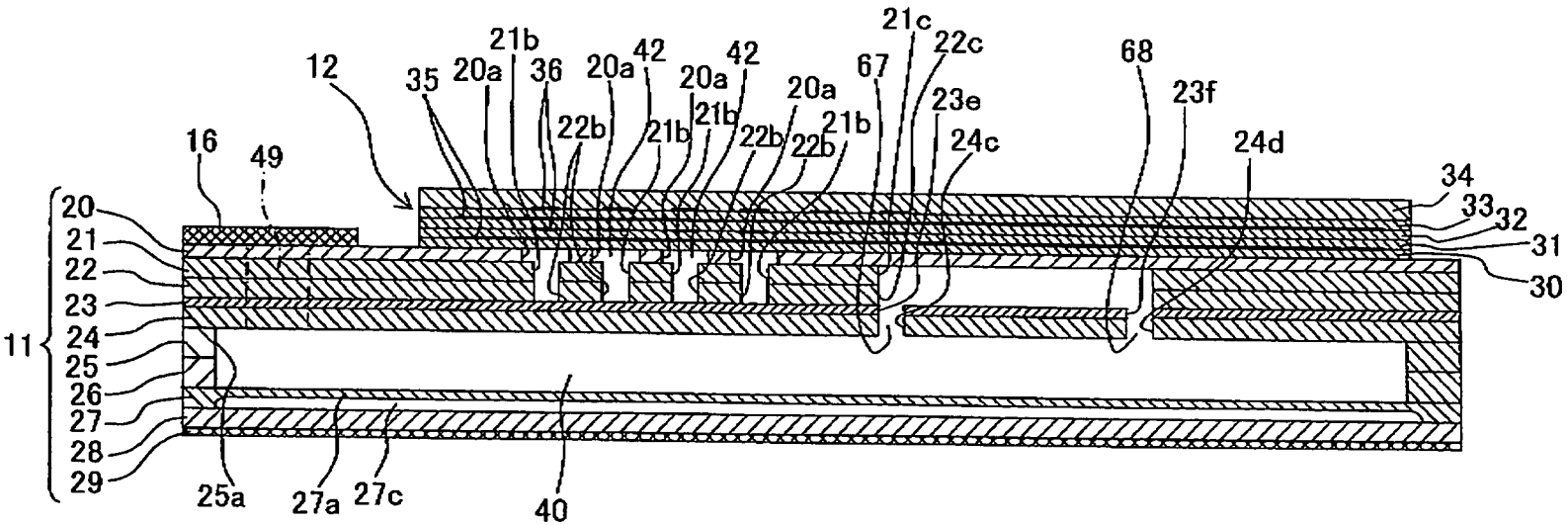
FIG. 3 is a cross-sectional view taken along a line III-III in FIG. 2.
Figure 4:
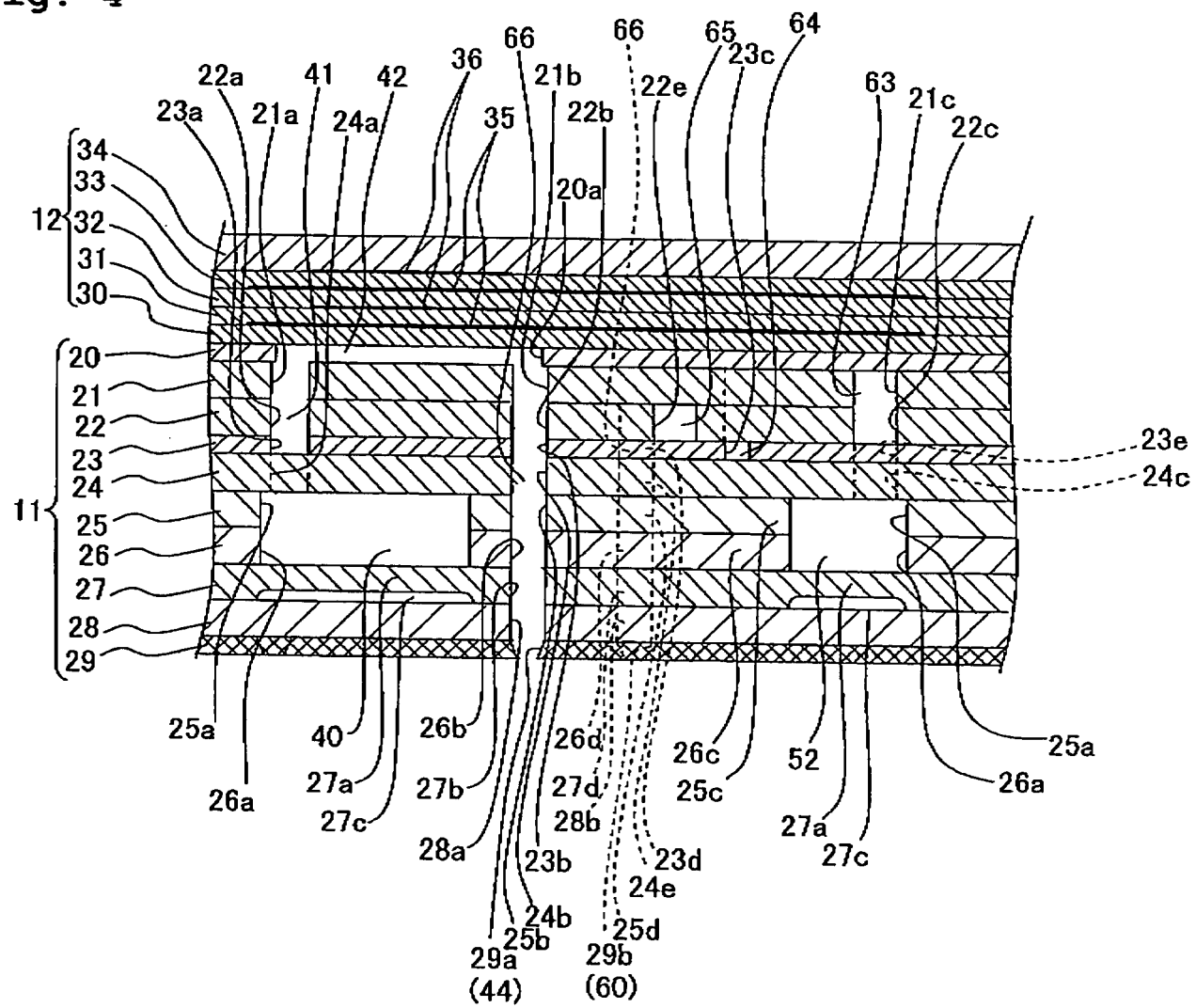
FIG. 4 is a cross-sectional view taken along a line IV-IV in FIG. 2.
Figure 5:
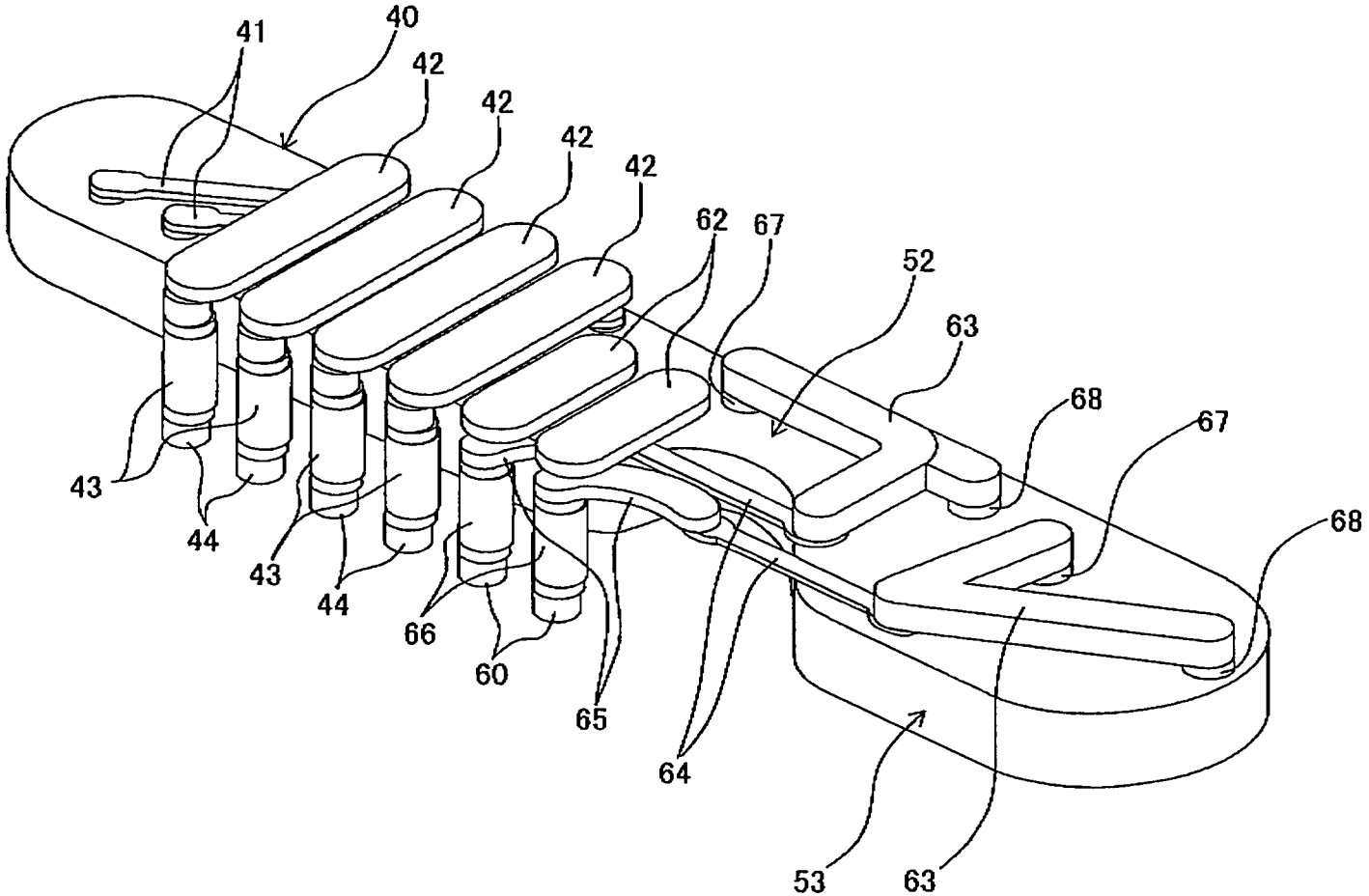
FIG. 5 is a perspective view showing an outline of a space inside the ink-jet head shown in FIG. 1.

FIG. 2 is a plan view of the ink-jet head 10 shown in FIG. 1. FIG. 3 is a cross-sectional view taken along a line III-III in FIG. 2. FIG. 4 is a cross-sectional view taken along a line IV-IV in FIG. 2. FIG. 5 is a perspective view showing an outline of a space inside the ink-jet head 10 shown in FIG. 1. As shown in FIG. 3 and FIG. 4, the ink-jet head 10 includes a channel unit 11 in which a plurality of plates are stacked, and an actuator 12 (pressure applying mechanism) which overlaps with and is adhered to a part of an upper surface of the channel unit 11. A plurality of nozzles 44 is formed in a lower surface of the channel unit 11, and ink droplets (liquid droplets) are jetted downward from the nozzles 44. Moreover, at a location on the upper surface of the channel unit 11 which is not covered with the actuator 12, filters 16 which remove dust mixed in the ink are arranged to cover an ink inlet ports 49.

As shown in FIG. 3 and FIG. 4, the channel unit 11 is formed by stacking in order from a top, a pressure chamber plate 20, a first communication passage plate 21, a second communication passage plate 22, a third communication passage plate 23, a fourth communication passage plate 24, a first manifold plate 25, a second manifold plate 26, a damper plate 27, a cover plate 28, and a nozzle plate 29, and adhering these plates. The nozzle plate 29 is a resin sheet of a material such as polyimide, and each of the plates 20 to 28 other than the nozzle plate 29 is a metallic plate of a material such as 42% nickel alloy steel (42 alloy). Each plate has a thickness of about 50 μm to 150 μm. Openings or recesses which form channels are formed in each of the plates 20 to 29 by a method such as an electrolytic etching, a laser machining, and a plasma-jet machining.

As it is shown in FIGS. 2 to 4, the pressure chamber plate 20 has a plurality of pressure chamber holes 20*a* arranged in a plurality of rows (two rows in the embodiment) along a long side of the pressure chamber plate 20. Each of the pressure chamber hole 20*a* has an elliptical shape with a long axis of the ellipse in the scanning direction in a plan view. Each pressure chamber hole 20*a* has an upper side and a lower side thereof closed by the actuator 12 and the first communication passage plate 21 respectively, thereby forming the pressure chamber 42. In other words, the actuator 12 is formed to cover the pressure chamber holes 20*a*. The nozzle plate 29 has a plurality of nozzle holes 29*a* each having a tapered shape with a diameter narrowed gradually in a downward direction, and each corresponding to one of the pressure chamber holes 20*a*.

Manifold holes 25*a* and 26*a* are formed in the first manifold plate 25 and the second manifold plate 26 under one of the rows of the pressure chamber holes 20*a* respectively, each extending in a direction of the row. Both the manifold holes 25*a* and 26*a* have an outline shape almost coinciding mutually, and the manifold holes 25*a* and 26*a* communicate with each other. Each of the manifold holes 25*a* and 26*a* has both ends extending to be longer than the row of the pressure chamber holes 20*a*. The manifold holes 25*a* and 26*a* have protrusions 25*c* and 26*c* respectively at one end portions thereof (end portions at an upper side in FIG. 2) not corresponding vertically to the pressure chamber holes 20*a*. Each of the protrusions 25*c* and 26*c* narrows a distance in a direction orthogonal to the extending direction.

The manifold holes 25*a* and 26*a* have an upper side and a lower side closed by the fourth communication passage plate 24 and the cover plate 27 respectively, thereby forming the common liquid chamber 40 and a pressure attenuation chamber 51. The common liquid chamber 40 communicates, at an end portion corresponding to the other end portions of the manifold holes 25*a* and 26*a* (end portions at a lower side in FIG. 2), with the ink inlet port 49 which is formed vertically through the first communication passage plate 21, second communication passage plate 22, and the third communication passage plate 23.

The pressure attenuation chamber 51 has a portion narrowed by the protrusions 25*c* and 26*c* as a throttled portion 52 and a portion on an opposite side of the common liquid chamber 40 with respect to the throttled portion 52 as an attenuation portion 53. The throttled portion 52 is formed to have a channel cross-sectional area in a direction orthogonal to the extending direction to be smaller than a channel cross-sectional area of the common liquid chamber 40, and moreover, the attenuation portion 53 is formed to have a channel cross-sectional area to be larger than the channel cross-sectional area of the throttled portion 52. A liquid supply chamber is formed by the attenuation portion 53, the throttled portion 52, and the common liquid chamber 40. The attenuation portion 53 communicates with the common liquid chamber 40 via the throttled portion 52. In other words, in the embodiment, the throttled portion 52 is formed at an end portion 40*a* (one end portion) of the common liquid chamber 40 on an opposite side of the ink inflow port 49, and the attenuation portion 53 communicates with the common liquid chamber 40 via the throttled portion 52. Consequently, an air bubble which is developed in the common liquid chamber 40 follows a flow of ink heading from the ink inflow port 49 to the end portion 40*a*, and flows into the attenuation portion 53 via the throttled portion 52. Since the cross-sectional area of the throttled portion 52 is smaller than the cross-sectional area of the attenuation portion 53, it is possible to prevent the air bubble which has flowed into the attenuation portion 53 from flowing back to the common liquid chamber 40. In other words, it is possible to prevent assuredly the air bubble which is developed in the common liquid chamber 40 from being accumulated in the common liquid chamber 40.

Each pressure chamber 42 in one row of the pressure chambers 42 communicates with the common liquid chamber 40 positioned at a lower side thereof via a communication passage 41. The communication passage 41 is formed by a connecting hole 21*a* of the first communication passage plate 21, a second connecting hole 22*a* of the second communication passage plate 22, an elongate hole 23*a* of the third communication passage plate 23, and a communicating hole 24*a* of the fourth communication passage plate 24. The elongate hole 23*a* is formed to be long and slender in a direction of a flat surface of the third communication passage plate 23, and one end in a longitudinal direction thereof communicates with one end of the pressure chamber 42 via the connecting hole 21*a* and the second connecting hole 22*a*, and the other end communicates with an upper surface of the common liquid chamber via the communicating hole 24*a*. In the communication passage 41, a communication passage throttled portion 41*a* is formed by the elongate hole 23*a*. The communication passage 41 has a channel cross-sectional area much smaller and a channel resistance much higher than those of an outflow channel 43 which will be described later.

The other end of the pressure chamber 42 communicates with one of the nozzle holes 29*a* via the outflow channel 43. The outflow channel 43 is formed by through holes 21*b*, 22*b*, 23*b*, 24*b*, 25*b*, 26*b*, 27*b*, and 28*a* which communicate with each other and are formed through the first communication passage plate 21, the second communication passage plate 22, the third communication passage plate 23, and the fourth communication passage plate 24, the first manifold plate 25, the second manifold plate 26, the damper plate 27, and the cover plate 28, respectively. The nozzle 44 is formed by the nozzle hole 29*a* in the nozzle plate 29.

The damper plate 27 has a damper wall 27*a* which is made thin by forming a recess from a side opposite to the manifold hole 26*a*.

The ink-jet head 10 has a dummy nozzle 60 which does not perform jetting for image formation. The dummy nozzle 60 communicates with the pressure attenuation chamber 51 which will be described later, and is formed for discharging air bubbles accumulated in the end portion 40*a* of the common liquid chamber 40 on a side opposite to the ink inflow port 49.

Figure 6:
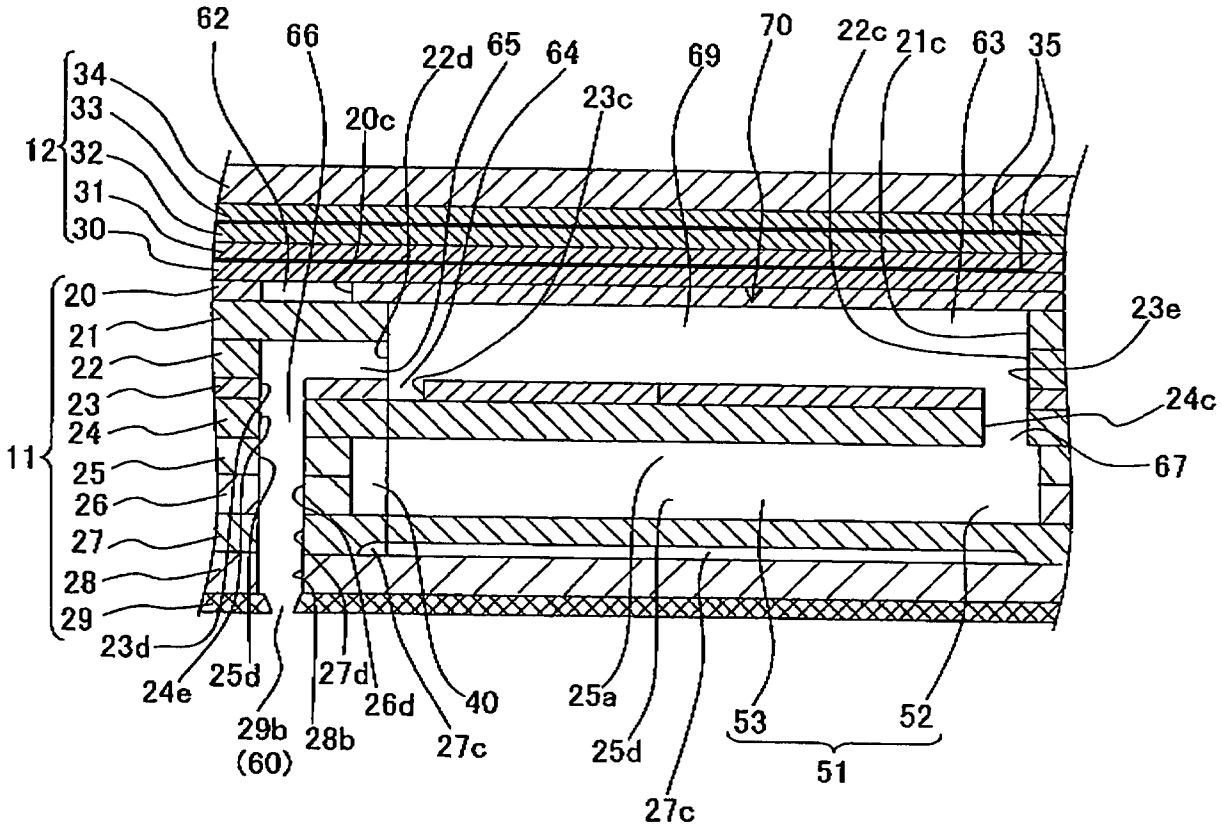
FIG. 6 is a cross-sectional view taken along a line VI-VI in FIG. 2.

In the embodiment, two discharge structures 70 each of which includes the dummy nozzle 60 have been provided. FIG. 6 is a cross-sectional view taken along a line VI-VI in FIG. 2. The description will be made while referring also to FIG. 2, FIG. 3, and FIG. 5. The two discharge structures 70 are different from each other in a shape and a connecting position of a channel in a plan view, but have same basic structure. A formation of only one discharge structure 70 will be described below, and regarding the other discharge structure, only the shape and the connecting position of the channel in a plan view will be described.

The nozzle plate 29 has dummy nozzle holes 29*b* each of which forms one of the dummy nozzles 60. A diameter of each of the dummy nozzle holes 29*b* becomes smaller in a downward direction.

The pressure chamber plate 20, further has a dummy pressure chamber holes 20*c*. Each of the dummy pressure chamber holes 20*c* has an elliptical shape with a long axis of the ellipse in the scanning direction. A length of the dummy pressure chamber hole 20*c* is shorter than a length of the pressure chamber hole 20*a*. The dummy pressure chamber hole 20*c* has an upper and a lower side closed by the actuator 12 and the first communication passage plate 21, thereby forming a dummy pressure chamber 62. The dummy pressure chambers 62 are arranged to be lined up with the pressure chambers 42 in a direction of the row of the pressure chambers 42, on an opposite side of the ink inflow port 49, and are arranged such that one ends of the dummy pressure chambers 62 overlap with the dummy nozzles 60 in a plan view respectively.

The first communication passage plate 21 and the second communication passage plate 22 further have channel chamber holes 21*c* and 22*c* each extending in a longitudinal direction of the plates (extending direction) in a plan view. Each of the channel chamber holes 21*c* and 22*c* branches at an intermediate portion thereof in a short side direction of the plate (scanning direction), thereby forming a T-shape. Both the channel chamber holes 21*c* and 22*c* have outline shapes that almost coincide mutually, and communicate with each other. The T-shaped channel chamber holes 21*c* and 22*c* have an upper side and a lower side closed by the pressure chamber plate 20 and the third communication passage plate 23 respectively, thereby forming a channel chamber 63 having the T-shape.

Moreover, one end in a longitudinal direction of the T-shaped channel chamber 63 communicates with the pressure attenuation chamber 51 via communicating holes 23*e* and 24*c* made through the third communication passage plate 23 and the fourth communication passage plate 24, and the other end in the longitudinal direction of the T-shaped channel chamber 63 communicates with the pressure attenuation chamber 51 via communicating holes 23*f* and 24*d* made through the same third communication passage plate 23 and the fourth communication passage plate 24. More elaborately, an open end of the communicating hole 24*c* opening toward the pressure attenuation chamber 51 forms a discharge port 67, and opens at a position in the vicinity of the throttled portion 52, in the pressure attenuation chamber 51, on a side of the common liquid chamber 40. An open end of the communicating hole 24*d* opening toward the pressure attenuation chamber 51 forms a discharge port 68, and opens at a position in the vicinity of the throttled portion 52, in the pressure attenuation chamber 51, on a side of the attenuation portion 53.

The T-shaped channel chamber 63 has a portion branched in the scanning direction from a position inclined on one side from a center between the discharge ports 67 and 68 of the channel chamber 63. A front end of the branched portion communicates with the dummy nozzle 60 which is formed in the vicinity of the common liquid chamber 40 on a side of the throttled portion 52, via a throttle 64, a connecting channel 65 for the dummy nozzle and an outflow channel 66 for the dummy nozzle.

The throttle 64 is formed by an upper side and a lower side of an elongate hole 23*c*, which extends in the extending direction and has been drilled through the third communication passage plate 23, being closed by the second communication passage plate 22 and the fourth communication passage plate 24. The connecting channel 65 for the dummy nozzle is formed by an upper side and a lower side of an elongate hole 22*d*, having been drilled through the second communication passage plate 22, being closed by the first communication passage plate 21 and the third communication passage plate 23. The front end of the branched portion of the T-shaped channel chamber 63 overlaps with one end of the throttle 64, and the other end of the throttle 64 communicates with one end of the connecting channel 65 for the dummy nozzle, thereby communicating mutually. A channel cross-sectional area of the throttle 64 is smaller than a channel cross-sectional area of the connecting channel 65 for the dummy nozzle, and the outflow channel 66 for the dummy nozzle, and a channel resistance of the throttle 64 is high.

The other end of the connecting channel 65 for the dummy nozzle communicates with the dummy nozzle 60 via the outflow channel 66 for the dummy nozzle. The outflow channel 66 for the dummy nozzle is formed by through holes 23*d*, 24*e*, 25*d*, 26*d*, 27*d*, and 28*b* which communicate with each other and are formed through the fourth communication passage plate 24, the first manifold plate 25, the second manifold plate 26, the damper plate 27, and the cover plate 28, respectively.

Moreover, discharge channel 69 which connects the pair of discharge ports 67 and 68 (discharge port group) and the dummy nozzle 60 is formed by the communicating holes 23*e*, 23*f*, 24*c*, 24*d*, the channel chamber 63, the throttle 64, the connecting channel 65 for the dummy nozzle, and the outflow channel 66 for the dummy nozzle. The discharge structure 70 (first discharge structure) is formed by the pair of discharge ports 67 and 68, the discharge channel 69, and the dummy nozzle 60.

The other discharge structure 70 (second discharge structure) will be described below. The channel chamber 63 is formed to be V-shaped in a plan view, and an apex 63*a* of the V shape communicates with the dummy nozzle 60 formed in the vicinity of the common liquid chamber 40 on a side of the throttled portion 52, via the throttle 64, the connecting channel 65 for the dummy nozzle, and the outflow channel 66 for the dummy nozzle. Moreover, both end portions of the V-shape communicate with the pair of discharge ports 67 and 68 respectively, via the communicating holes 23*e*, 23*f*, 24*c*, and 24*d*. The discharge ports 67 and 68 are arranged to be isolated from each other in the extending direction, and communicate with the attenuation portion 53 at positions of the attenuation portion 53 away from the throttled portion 52, in the extending direction, farther than the discharge structure 70 described above. Preferably, one discharge port 68 is arranged adjacent to the front end portion of the attenuation portion 53 in the extending direction (innermost end when viewed from the common liquid chamber 40). Various holes, chambers, and channels etc. forming the other discharge structure 70 are formed in the same plates as in the discharge structure 70 described above. In the following description, for describing the two discharge structures 70 distinctly, a reference numeral "A" is assigned to one discharge structure 70 and a reference numeral "B" is assigned to the other discharge structure 70.

As the actuator 12, various types of actuators such as a piezoelectric drive actuator, an electrostatic drive actuator, and a heat generating actuator are applicable. In the embodiment, the piezoelectric drive actuator is used. As shown in FIG. 3, FIG. 4, and FIG. 6, in the actuator 12, a multiple number of piezoelectric sheets 30, 31, 32, and 33 (hereinafter sheets 30 to 33) made of a ceramics material of lead zirconium titanate (PZT), each having a thickness of about 30 μm, and a top sheet 34 which has an insulating property are stacked. On an upper surface of each of the odd numbered sheets 30 and 32 when counted upward from the lowermost piezoelectric sheet 30 from among the piezoelectric sheets 30 to 33, a common electrode 35 which is arranged continuously corresponding to the plurality of pressure chambers 42 is formed by printing. On an upper surface of each of the even numbered sheets 31 and 33 when counted upward from the lowermost piezoelectric sheet 30, a plurality of individual electrodes 36 each of which is arranged corresponding to one of the pressure chambers 42 is formed.

Next, an operation of the ink-jet head will be described below. Ink which is infused through the ink infusion hole 49 is filled from the common liquid chamber 40 up to the nozzle 44. Moreover, the ink is filled from the pressure attenuation chamber 51 up to the dummy nozzle 60. The ink forms a meniscus inside the nozzle 44 and the dummy nozzle 60, which is an interface with an atmosphere. This meniscus, when the ink is not being jetted, is maintained to be in a concave surface form by a back pressure (a pressure which pulls in a direction opposite to a direction of jetting) which acts on the ink as it has hitherto been known, and the ink does not overflow.

As shown in FIG. 3, when a voltage is selectively applied to the individual electrode 36 of the actuator 12, and an electric potential difference is developed between the individual electrode 36 and the common electrode 35, an electric field acts on an active portion positioned between the common electrode 35 and the individual electrode 36 of the piezoelectric sheets 30 to 33, and there is a deformation due to a distortion in a direction of stacking. Due to the deformation of the active portion, when a pressure (pressure change) is caused in the ink inside the pressure chamber 42, the ink passes through the outflow channel 43 and is jetted as an ink droplet from the nozzle 44. When the ink is jetted, a pressure wave is generated due to the pressure change in the ink inside the pressure chamber 42. This pressure wave has not only a forward-moving component which moves toward the nozzle 44 for jetting the ink droplets from the nozzle 44 but also a backward moving component which moves toward the common liquid chamber 40. The backward-moving component of the pressure wave is intercepted to some extent by a communication passage throttled portion 41*b*, but a part of the backward-moving component is propagated to the common liquid chamber 40. The backward-moving component of the pressure wave which is propagated to the common liquid chamber 40 is absorbed to some extent by an elastic deformation of the damper wall 27*a* which is thin.

Furthermore, the channel cross-sectional area of the throttled portion 52 being smaller than the channel cross-sectional area of the common liquid chamber 40, a part of the backward-moving component of the pressure wave is reflected at a boundary between the throttled portion 52 and the common liquid chamber 40, and returns toward the common liquid chamber 40, and the remaining part of the backward-moving component passes through the throttled portion 52 and is propagated up to the attenuation portion 53.

Moreover, the channel cross-sectional area of the attenuation portion 53 being greater than the channel cross-sectional area of the throttled portion 52, a part of the pressure wave which is propagated to the attenuation portion 53 and returns to the throttled portion 52 after being reflected inside the attenuation portion 53, returns to the attenuation portion 53 after being reflected at the boundary between the attenuation portion 53 and the throttled portion 52, and the remaining part of the pressure wave passes through the throttled portion 52 and is propagated to the common liquid chamber 40. Accordingly, it is possible to attenuate the pressure wave efficiently in the common liquid chamber 40, and a so-called cross-talk, in which the backward-moving component of the pressure wave generated in the pressure chamber 42 is propagated to the other pressure chamber 42 via the common liquid chamber 40, is suppressed effectively.

When the backward-moving component of the pressure wave passes through the throttled portion 52, a part of the backward-moving component passes through one discharge port 67A, and is propagated to the channel chamber 63A. Moreover, a part of the backward-moving component passes through the other discharge port 68A and is propagated to the channel chamber 63A. A part of the pressure wave which is propagated from both ends of the channel chamber 63A makes an attempt to be propagated to the throttle 64A, but due to the high channel resistance thereof, the part of the pressure wave is escaped toward the discharge port on a lower pressure side, out of the discharge ports 67A and 68A. When a length of each of the discharge channels extending from both discharge ports 67A and 68A up to a merging point inside the channel chamber 63A is set such that there occurs a phase difference in the pressure wave, it is possible to offset the pressure wave which is propagated from both sides, to some extent.

As a result of this, it is possible to reduce the pressure wave which is propagated to the throttle 64A. Since it is possible to attenuate the pressure wave further in the throttle 64A, a high-pressure wave does not reach the dummy nozzle 70, and it is possible to prevent unnecessary jetting of ink droplets due to the concentration of the pressure wave. Such action and effect are shown similarly in the discharge structure 70B, and it is possible to prevent unnecessary jetting of ink droplets from the dummy nozzle 60B due to the concentration of the pressure wave.

Moreover, in each discharge structure 70, since both the discharge ports 67 and 68 are arranged to be isolated in a direction of extension of the common liquid chamber 40, a difference of high and low is developed in the pressure wave which is propagated to the pressure attenuation chamber 51 at a position of each of the discharge ports 67 and 68. Accordingly, it is possible to release the pressure wave propagated from one discharge port 67 (or 68) to the discharge channel, to one of the discharge ports 67 and 68 at which the pressure is lower than the other discharge port.

Moreover, in the discharge structure 70A, a total of channel length of a discharge channel from one discharge port 67 up to a joining point of the channel chamber 63A through the communicating holes 23*e* and 24*c*, and channel length of a discharge channel from the other discharge port 68 up to the joining point of the channel chamber 63A through the communicating holes 23*f* and 24*d*, is formed to be greater than a direct distance between the both discharge ports 67 and 68. By forming the channel chamber 63B to be V-shaped as in the discharge structure 70B, it is possible to increase further the difference in the distance described above. Accordingly, it is possible to attenuate effectively the pressure wave which is propagated from each of the discharge ports 67 and 68 up to the dummy nozzle 60 via the discharge channel 69, and to release the pressure wave which is propagated from one discharge port 67 (or 68) to the discharge port at a low pressure. As a result of this, it is possible to suppress the pressure wave from being concentrated at the dummy nozzle 60, and to suppress the unnecessary jetting of liquid droplets from the dummy nozzle 60. Moreover, it is easily possible to shift the phase of the two pressure waves, and to suppress the concentration of the pressure waves at the dummy nozzle 60.

Furthermore, even by forming the two discharge structures 70A and 70B, it is possible to disperse the pressure wave which acts on each of the dummy nozzles 60A and 60B. Particularly, when the two discharge structures 70 are arranged to be separated by a distance in the extending direction which is the direction in which the pressure wave is propagated, these two discharge structures 70 attenuate the pressure wave independently without affecting mutually, and it is possible to reduce the pressure change which acts on each of the dummy nozzles 60A and 60B.

In the embodiment, a case in which two discharge structures 70 are provided has been described. However, the number of the discharge structures is not restricted to two, and there may be one discharge structure 70, or three or more discharge structures 70 may be provided. Or, the discharge ports 67 and 68 in the discharge structure 70 are not restricted to two, and there may be three or more discharge ports. Furthermore, the shape of the channel chamber 63 is not restricted to the shape described above, and it may be a U-shape, provided that it communicates with at least two discharge ports and dummy nozzles 60. In such cases, the pressure attenuation chamber 51 is not necessarily required to be provided at the end portion side of the common liquid chamber 40.

Moreover, in a structure, in which the pressure wave inside the common liquid chamber 40 is attenuated by the pressure attenuation chamber 51 and the pressure wave which is propagated to the dummy nozzle 60 is attenuated by the throttle 64 of the discharge channel 69, the discharge structure 70 may include only one discharge port 67 (or 68). In order to remove an air bubble accumulated in the common liquid chamber 40 and the pressure attenuation chamber 51, the air bubble may be sucked together with the ink from the nozzles 44 and the dummy nozzles 60. For example, it is possible to apply a negative pressure to all the nozzles 44 and the dummy nozzles 60 upon covering the plurality of nozzles 44 and the dummy nozzles 60 by a cap 80 which is connected to a suction pump P (sucking mechanism) as shown in FIG. 1, thereby sucking the air bubble from the nozzles 44 and the dummy nozzles 60. Conversely, the air bubble may be pushed together with the ink from the nozzles 44 and the dummy nozzles 60 by applying a positive pressure to an ink supply source connected to the ink inflow port 49. In these cases, the channel resistance from the common liquid chamber 40 up to the dummy nozzles 60 (two dummy nozzles) being set to be lower than the channel resistance from the common liquid chamber 40 up to the nozzles 44, a flow of ink from the ink inflow port 49 toward the common liquid chamber 50 and the pressure attenuation chamber 51 is generated, and it is possible to discharge the air bubble together with the ink from the dummy nozzle 60 through the discharge ports 67 and 68.

In a case of one dummy nozzle 60, it is preferable to set the channel resistance to be greater than a diameter of the nozzle 44 by increasing a diameter of the dummy nozzle 60.

Moreover, by forming the dummy pressure chamber 62 above the dummy nozzle 60, it is possible to uniform a stiffness of the pressure chamber 42 formed near the dummy pressure chamber 62 and a stiffness of the other pressure chambers 42, and to uniform the ink droplets jetted from each nozzle 44.

It is also possible to connect the connecting channel 65 for the dummy nozzle to one end of the dummy pressure chamber 62, and to connect the other end of the dummy pressure chamber 62 to the outflow channel 66 for the dummy nozzle. Moreover, it is also possible to arrange the common electrode 35 and the individual electrode 36 in the actuator 12 corresponding to the upper side of the dummy pressure chamber 62. By the structure described above, although the dummy nozzle 60 is not used for the image formation, at the time of a flushing operation, it is possible to jet an air bubble together with the ink droplets from the dummy nozzle 60 by driving the actuator 12.

In the embodiment described above, the dummy nozzle 60 is formed in the vicinity of the one end portion 40*a* of the common liquid chamber 40. However, a position of forming the dummy nozzle 60 is not restricted to this position, provided that, it is a position which makes it possible to secure the channel length of the discharge channel 69, and to attenuate sufficiently the pressure wave which is propagated to the dummy nozzle 60. Moreover, the cap 80 need not cover all the plurality of nozzles 44 and the dummy nozzles 60, and may be formed to cover only the dummy nozzles 60, for example. It is possible to remove an air bubble developed in the common liquid chamber 40 and the pressure attenuation chamber 51 even by sucking the ink only from the dummy nozzles 60 by applying the negative pressure only to the dummy nozzles 60.

The embodiment described above is an embodiment in which the present invention is applied to an ink-jet head used in an ink-jet printer. However, the present invention is also applicable to any other apparatus, provided that the apparatus has a dummy nozzle which discharges an air bubble developed in a liquid chamber, and it is necessary to prevent the dummy nozzle from jetting undesired liquid droplets caused by propagation of a pressure wave at the time of jetting liquid droplets. In this case, a liquid to be jetted is not restricted to ink and may be a liquid such as a reagent, a biomedical solution, a wiring material solution, an electronic material solution, and a colored liquid. Moreover, the recording medium is not restricted to a recording paper, and may be medium such as a cloth and a resin sheet, and the similar effect is achieved.

What is claimed is:

1. A liquid droplet jetting apparatus which jets a droplet of a liquid, comprising:

a common liquid chamber to which the liquid is supplied;

a plurality of pressure chambers which communicate with the common liquid chamber and which causes a pressure change in the liquid;

a plurality of nozzles which communicate with the pressure chambers respectively, and each of which jets the droplet of the liquid;

a pressure attenuation chamber which has a throttled portion having a cross-sectional area smaller than a cross-sectional area of the common liquid chamber, and an attenuation portion having a cross-sectional area greater than the cross-sectional area of the throttled portion, the attenuation portion being connected to the common liquid chamber via the throttled portion;

a discharge port which is formed in the pressure attenuation chamber;

a discharge channel which is connected to the discharge port and having a throttle in which a channel area of the discharge channel is decreased;

and a dummy nozzle which is connected to the discharge port via the discharge channel, and which is open to an atmosphere.

2. The liquid droplet jetting apparatus according to claim 1, wherein the common liquid chamber extends in a predetermined direction, and the attenuation portion is arranged adjacent to the common liquid chamber in the predetermined direction and connected to an end portion of the common liquid chamber via the throttled portion.

3. The liquid droplet jetting apparatus according to claim 2, further comprising a pressure applying mechanism which is formed to cover the pressure chambers.

4. The liquid droplet jetting apparatus according to claim 3, wherein the dummy nozzle is formed in the vicinity of the end portion of the common liquid chamber.

5. The liquid droplet jetting apparatus according to claim 1, further comprising a plurality of discharge structures each of which includes the discharge port, the discharge channel, and the dummy nozzle.

6. The liquid droplet jetting apparatus according to claim 5, wherein the discharge structures include a first discharge structure which includes the discharge port formed in the vicinity of the throttled portion, and a second discharge structure which includes the discharge port formed in the attenuation portion at a position away from the throttled portion.

7. A liquid droplet jetting apparatus which jets a droplet of a liquid, comprising:

a liquid supply chamber to which the liquid is supplied;

a plurality of pressure chambers which communicate with the liquid supply chamber and which causes a pressure change in the liquid;

a plurality of nozzles which communicate with the pressure chambers respectively, and each of which jets the droplet of the liquid;

a discharge port group which includes a plurality of discharge ports formed in the liquid supply chamber;

a plurality of discharge channels which are connected to the discharge ports of the discharge port group respectively, and which communicate with each other; and a dummy nozzle which is connected to the discharge ports via the discharge channels, and which is open to an atmosphere.

8. The liquid droplet jetting apparatus according to claim 7, wherein the liquid supply chamber extends in a predetermined direction, and the discharge ports included in the discharge port group are formed in the predetermined direction to be isolated from each other.

9. The liquid droplet jetting apparatus according to claim 7, wherein a total of channel lengths of two discharge channels, among the plurality of discharge channels, communicating with two discharge ports among the plurality of discharge ports in the discharge port group respectively, is greater than a direct distance between the two discharge ports.

10. The liquid droplet jetting apparatus according to claim 9, wherein the two discharge channels are joined with each other in a V-shape and then connected to the dummy nozzle.

11. The liquid droplet jetting apparatus according to claim 7, wherein the discharge channels are joined with each other at a predetermined position and then connected to the dummy nozzle, and a throttle in which a channel area is reduced than those of the discharge channels is formed between the predetermined position and the dummy nozzle.

12. The liquid droplet jetting apparatus according to claim 7, further comprising a plurality of discharge structures each of which includes the discharge port group, the plurality of discharge channels, and the dummy nozzle.

13. The liquid droplet jetting apparatus according to claim 7, wherein the liquid supply chamber has a common liquid chamber which extends in a predetermined direction and which is connected to the pressure chambers; and a pressure attenuation chamber which includes a throttled portion having a cross-sectional area smaller than a cross-sectional area of the common liquid chamber, and an attenuation portion having a cross-sectional area greater than the cross-sectional area of the throttled portion, the attenuation portion being arranged adjacent to the common liquid chamber in the predetermined direction and connected to an end portion of the common liquid chamber via the throttled portion, and the discharge port group is formed in the pressure attenuation chamber.

14. The liquid droplet jetting apparatus according to claim 13, further comprising a plurality of discharge structures each of which includes the discharge port group, the plurality of discharge channels, and the dummy nozzle; wherein the discharge structures have a first discharge structure in which the discharge port group is formed in the vicinity of the throttled portion, and a second discharge structure in which the discharge port group is formed in the attenuation portion at a position away from the throttled portion.

15. The liquid droplet jetting apparatus according to claim 14, wherein the discharge ports of the discharge port group in the first discharge structure include a discharge port formed in the common liquid chamber and a discharge port formed in the attenuation portion; and the discharge ports of the discharge port group of the second discharge structure are all formed in the attenuation portion.

16. The liquid droplet jetting apparatus according to claim 14, wherein the dummy nozzle in each of the first discharge structure and the second discharge structure is formed in the vicinity of the end portion of the common liquid chamber.

17. The liquid droplet jetting apparatus according to claim 7, further comprising a pressure applying mechanism which is formed to cover the pressure chambers.

18. A recording apparatus which performs recording on a recording medium by jetting a droplet of a liquid, comprising: the liquid droplet jetting apparatus as defined in claim 17; and a transporting mechanism which transports the recording medium in a predetermined direction.

19. The recording apparatus according to claim 18, further comprising a sucking mechanism which covers the nozzles and the dummy nozzle of the liquid droplet jetting apparatus and which sucks the liquid from the nozzles and the dummy nozzle.

20. The recording apparatus according to claim 19, wherein the liquid supply chamber of the liquid droplet jetting apparatus extends in the predetermined direction, and the discharge ports included in the discharge port group are formed in the predetermined direction to be isolated from each other.

21. The recording apparatus according to claim 20, wherein the liquid supply chamber has a common liquid chamber which extends in the predetermined direction and which is connected to the pressure chambers; and a pressure attenuation chamber including a throttled portion of which a cross-sectional area is smaller than a cross-sectional area of the common liquid chamber and an attenuation portion of which a cross-sectional area is greater than the cross-sectional area of the throttled portion, the attenuation portion being connected to an end portion of the common liquid chamber via the throttled portion; wherein the discharge port group is formed in the pressure attenuation chamber.

22. The liquid droplet jetting apparatus according to claim 7, wherein the plurality of discharge channels includes a first discharge channel and a second discharge channel which is longer than the first discharge channel and communicated with the first discharge channel.

* * * * *